United States Patent [19]

Kersey

[11] Patent Number: 4,908,742

[45] Date of Patent: Mar. 13, 1990

[54] PORTABLE DESK UNIT

[76] Inventor: Denise A. Kersey, 1708 Walpole Pl., Modesto, Calif. 95351

[21] Appl. No.: 354,758

[22] Filed: May 22, 1989

[51] Int. Cl.[4] ..... A45C 15/06

[52] U.S. Cl. ..... 362/156; 362/33; 362/99; 362/155; 362/234; 108/23

[58] Field of Search ..... 108/23; 362/33, 98, 362/99, 154, 155, 234, 238, 249, 251, 253, 156

[56] References Cited

U.S. PATENT DOCUMENTS

| | | | |
|---|---|---|---|
| 2,749,430 | 6/1956 | Cohn | 362/98 |
| 3,885,145 | 5/1975 | Wise | 362/99 |
| 4,290,093 | 9/1981 | Thompson | 362/98 |
| 4,312,507 | 1/1982 | Smith et al. | 108/23 X |
| 4,700,634 | 10/1987 | Mills | 108/43 |

*Primary Examiner*—Stephen F. Husar

[57] ABSTRACT

A portably writing box usable primarily by children during long automobile trips. The writing surface is illuminated by three separate lamp mechanisms arranged along three different edges of the writing surface. Light rays are directed onto the writing surface from three different directions, thereby eliminating shadows that might otherwise be generated by a single light source located only long one edge of the writing surface. The writing box preferably includes a transistor radio on the lid of the box, such that the child can choose between writing on the writing surface or listening to the radio.

8 Claims, 1 Drawing Sheet

PORTABLE DESK UNIT

BACKGROUND AND SUMMARY OF THE INVENTION

This invention relates to a portable writing box usable primarily by children during long automobile trips to keep themselves busy or amused. The portable writing box will be constructed to resemble a small brief case or suitcase, such that a child can readily carry it "suitcase fashion" to and from an automobile. The box will be openable to uncover a writing surface; that surface can, e.g. be a chalkboard, or a paper pad, or a small coloring book, or a hard smooth plastic writing surface. The nature of the writing surface will depend to a certain extent or the childrens age group for which the writing box is designed.

An important feature of my invention is the inclusion of electric illumination mechanisms along three edge areas of the writing surface. Light rays are directed across the writing surface from three different directions, such that the child's hand or arm will not cast a shadow on the area being written upon. This is considered important, especially in the case of automobile trips during night time hours. The localized light rays are concentrated directly on the writing surface without causing a shadow or a distraction to the driver or other passengers in the automobile.

The writing box carries a number of dry cell batteries to provide electrical power for the electric lamps (lights) that illuminate the writing surface. Preferably, a control switch is interconnected with the lid of the writing box so that when the lid is closed the lights are automatically turned off. When the lid is opened the lights automatically go on to illuminate the writing surface. Thus, the child can operate (control) the lighting mechanism in a darkened automobile without having to search for a light switch.

To increase the versatility (usefulness) of the writing box, I propose to include a small transistor radio and headphone assembly into the box structure. The aim is to give the child a choice of activities to pursue, i.e. writing (or coloring), or listening to the radio. The radio is preferably controlled automatically so that it turns on only when the headphones are in position on the child's head. Thus, the child is not required to search in the dark for a manual switch in order to turn on the radio. Instead, the child merely places the headphones on his/her head; the radio is turned on automatically.

The portable writing box is constructed as a relatively compact foldable unit approximately the same size as a small brief case. It is preferably light in weight so that is can be held on the hild's lap without excessive weight or burden on the child's body. As previously noted, automatic switches are incorporated into the writing box, such that the writing surface is automatically illuminated merely be opening the box; the radio is automatically turned on by putting the headphones on the person's head.

Prior to my invention, others have proposed portable "breifcase" size units having illumination mechanisms for illuminating magazines or books. U.S. Pat. No. 4,290,093 to T. Thompson shows a briefcase unit wherein a panel member 14 serves as a support for a magazine. A switch 52 is mounted in the cover to turn lamps 46 on or off, depending on whether the cover is opened or closed.

U.S. Pat. No. 3,885,145 discloses an openable box-like unit wherein a small light bulb 43 is mounted in a housing 42 to direct light rays angularly onto the exposed pages of a book.

U.S. Pat. No. 2,749,430 to M. Cohn shows a writing desk attachable onto the dashboard of an automobile alongside the driver space An electric lamp 40 is arranged above the front edge of the desk to direct light rays onto a writing pad 33. U.S. Pat. No. 4,700,634 to A. Mills et al shows a lap-supported desk unit having an illumination unit 27 located on an articulated arm assembly for illuminating different areas of a writing surface.

My proposed portable writing box is believed to offer advantages over the units disclosed in the above mentioned patents.

THE DRAWING

DESCRIPTION OF A PREFERRED EMBODIMENT OF THE INVENTION

Figure 1:
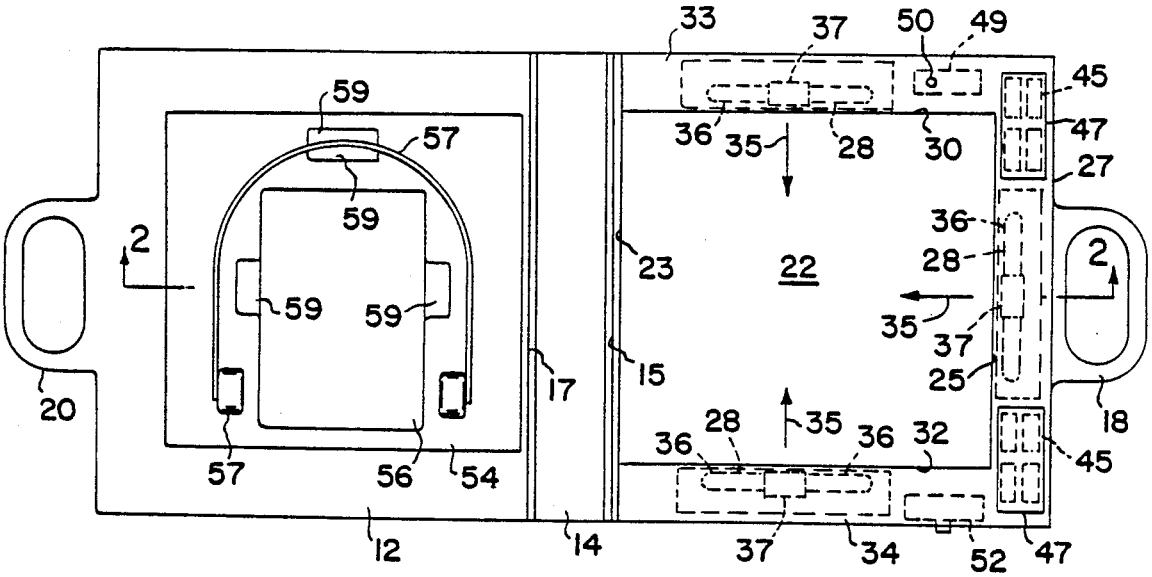
FIG. 1 is a top plan view of a portable writing box embodying my invention.
Figure 2:
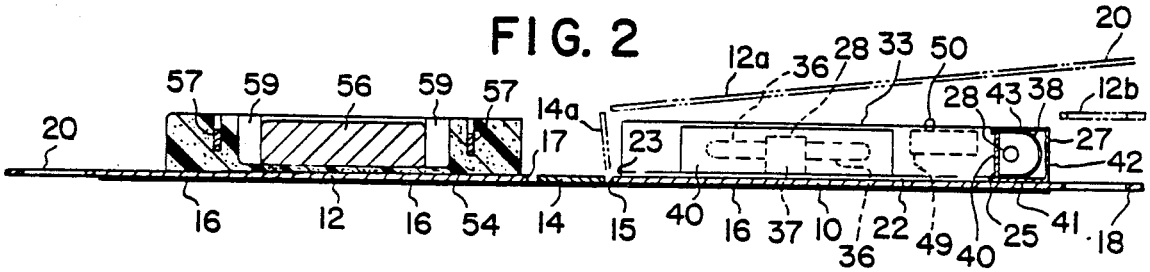
FIG. 2 is a sectional view taken on line 2—2 in FIG. 1.

FIG. 1 shows a writing box of the present invention, comprising a first rigid rectangular panel 10, a second rigid rectangular panel 12, and a rigid connector strip 14. The two panels and intervening connector strip are adhesively or otherwise secured to a thin flexible plastic sheet of material 16. Sheet 16 securely ties the panels and connector strip together while permitting the panels to be folded around their hinged connecting edges 15 and 17 with strip 14. FIG. 2 shows in dashed lines how panel 12 and strip 14 can be swung to intermediate positions **12*a* and 14*a*. Numeral 12*b* fragmentarily shows the position of panel 12 folded to a final position parallel to, and directly above, panel 10. Each panel 10 and 12 has a carrying handle 1 or 20 formed as an integral extension of the panel free edge, i.e. the panel edge opposite hinged edge 15 or 17**.

The full line in FIGS. 1 and 2 show the writing box in its unfolded position ready for use. The dashed lines in FIG. 2 illustrate the box as it is being folded up for carrying purposes. In the folded-up condition of the box, handles 18 and 20 will be in sufficient proximity to each other as to capable of being jointly grasped by a person's hand for carrying purposes. The box will be carried in "suitcase" fashion at the person's side.

Panel 10 serves as a base for a writing surface means 22. As seen in FIGS. 1 and 2, the writing means comprises a chalkboard having a left edge 23 in near proximity to panel edge 15, and a right edge 25 in near proximity to a hood structure 27. An electric illumination means 28 is disposed within hood structure 27 to direct light rays onto the chalkboard surface. The upper and lower edges 30 and 32 of the chalkboard (FIG. 1) are in near proximity to hood structures 33 and 34. Each hood structure contains an electric illumination means 28.

An important feature of my invention is the fact that there are three different illumination mechanisms 28 for directing light rays in three different directions onto the chalkboard surface, as indicated by numerals 35 in FIG. 1. When the portable writing box is used for writing purposes in a darkened automobile (during the night hours) the illumination mechanisms 28 will be the sole source of illumination for the chalkboard surface. If the chalkboard were to be illuminated from only a single light source along one edge of the chalkboard the child's hand and arm would inevitably case a shadow on the board surface, thereby making it more difficult to see the written information. By illuminating the chalkboard surface from three different directions the shadows are substantially or completely eliminated.

The writing surface means 22 can be a device other than a chalkboard, e.g. a writing pad containing multiple tear-off pages, or a small coloring book, or an erasable plastic marking surface. In any case, the writing surface will be illuminated from three different directions.

Each illumination means 28 comprises two electric lamps 36 mounted in a double socket structure 37. A curved reflector 38 is located behind the two lamps to direct light rays outwardly through a frosted semi-transparent window 40. The illumination means is located within a hood structure 27, 33 or 34.

Each hood structure extends substantially along the entire length of a free edge of panel 10. As seen in FIG. 2, the hood structure has a channel cross section, comprising a floor 41, upstanding wall 42, and roof 43. Each hood structure is similarly constructed.

The various electric lamps 36 are powered by dry cell batteries 45 mounted within hood structure 27; as shown in FIG. 1, there are eight batteries arranged in two groups (four batteries per group) An access plate 47 may be mounted in an opening in hood structure roof 43 over each group of batteries. The hood structures provide space for the wiring that interconnects the batteries with lamps 36.

Since the portable writing box will be used in a darkened automobile it is desirable to have the electric lamps go on automatically when the box is opened (rather than requiring the child to hunt for a control switch in the dark). An electric switch 49 is mounted within hood structure 33 so that its actuator button 50 projects above the hood structure roof surface When panel 12 is swung to a closed position it will contact the roof walls 43 of the various hood structures 27, 33 and 34. Actuator button 50 will be depressed to cause switch 49 to be operated to the circuit-open condition. When the box is closed lamps 36 will be automatically turned off; when the box is opened (as shown in full lines in FIGS. 1 and 2) the lamps will go on automatically.

When the writing box is used during daylight hours it may not be necessary to have lamps 36 turned on. A manual switch 52 may be mounted in hood structure 34 to override switch 49, i.e. turn the lamps off.

The aforementioned panel 12 can be used solely as a lid for the portable writing box However, to increase the versatility of the box, panel 12 can be used to mount a small radio and set of headphones The child can thereby have a choice of writing on surface 32 or listening to the radio. The headphones control the radio sound so that only the person wearing the headphones will hear the radio; other person in the automobile will not be disturbed.

As shown in FIGS. 1 and 2, panel 12 carries a block 54 formed of semi-rigid plastic foam material (e.g. styrofoam). Recesses are formed in the exposed face of the block to receive a small transistor radio 56 and headphone set 57 The recesses closely conform to the contours on the radio and headphones, such that the foam material exerts a gripping action thereon. When panel 12 is swung to the overturned closed position (dashed lines in FIG. 2) the radio and headphones will remain in the associated recesses in block 54. Block 54 is dimensioned so that when panel 12 is in its closed position, the block will fit into the space circumscribed by hood structure 27, 33 and 34.

To facilitate removal of the headphones and/or radio from block 54, the block may have finger-reception indentations (depressions) 59 therein.

Figure 3:
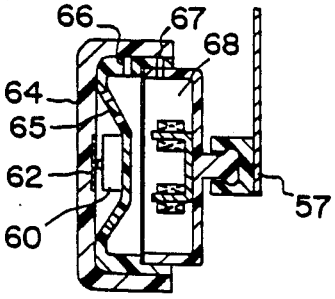
FIG. 3 is an enlarged fragmentary sectional view through a headphone used in the FIG. 1 device.

Preferably the radio is automatically controlled so that the child does not have to search for a turn-on button in the dark. FIG. 3 shows a radio control switch 60 incorporated into an headphone earpiece, such that the pressure of the child's ear against the earpiece will automatically turn on the radio. Thus, by putting on the headphones the child automatically turns on the radio Conversely, by removing the headphones, the child automatically turns off the radio. There is no need for the child to hunt in the dark for a control knob or button.

The control switch shown in FIG. 3 has an actuator button in registry with a rigid plate 62 built into a foam covering 64 for the earpiece Pressure of the person's ear against covering 64 will slightly depress plate 62, thereby actuating switch 60. The wiring for switch 60 can go through one of the openings in wall 65, thence through openings 66 and 67 into chamber 68 that houses the speaker coil. The switch 60 wiring can then be part of the harness wiring for the coil.

The portable writing box can be used in its opened position (FIG. 1 and 2) for writing purposes or for radio listening purposes. However, a somewhat more compact position is possible by folding panel 12 so that it is directly below (and against) panel 10 (with flexible sheet 16 doubled back on itself). With panel 12 folded underneath panel 10 the writing box can be set on the child's lap and used for writing purposes; panel 12 is out of the way so that the box has a relatively small plan area on the child's lap. By turning the box upside down the radio will be exposed, and thus made accessible for listening purposes.

The drawings show one form that the invention can take. Other forms are possible.

I claim:

1. A portable writing box comprising a first rectangular panel, a second rectangular panel, a connector strip hingedly connected to adjacent edge areas of said panels, whereby the panels can be oriented in a common horizontal plane or in different horizontal planes one above the other;

said first panel having one edge thereof hindedly attached to the connector strip, and three other free eges; three hood structures carried on one face of said first panel in near proximity to said three other edges, each said hood structure extending along substantially the entire length of the associated panel free edge.

a writing surface means carried on said one face of said first panel in the space circumscribed by said one panel edge and said three hood structures; and an electric illumination means located in each hood structure; each illumination means comprising at least one electric lamp and a reflector mounted within the associated hood structure to direct light rays toward a central point on the writing surface means, whereby shadows on the writing surface are substantially eliminated.

2. The writing box of claim 1 wherein said writing surface means is a chalkboard sized to span substantially the entire panel face area circumscribed by the three hood structures and said one panel edge.

3. The writing box of claim 1 wherein said writing surface means is a writing pad having a number of tear-off pages.

4. The writing box of claim 1 and further comprising dry cell battery means located within at least one of the hood structures for energizing the electric lamps.

5. The writing box of claim 1 wherein each hood structure has a flat roof wall extending parallel to said first panel; the roof walls on said three hood structures being in a common plane space above the first panel, whereby said roof walls will contact the second panel when said second panel is swung to a position overlying the first panel.

6. The writing box of claim 5 and further comprising a carrying handle extending from a free edge of each panel, said carrying handles being located so that when the second panel is swung to a position overlying the first panel the two handles will be in position to be jointly grasped by a person's hand for carrying purposes.

7. The writing box of claim 1 and further comprising a block carried on one face of said second panel, and a radio-headphone assembly supported on said block; said block being dimensioned to fit into the space circumscribed by the aforementioned hood structures when the second panel is swung to a position overlying the first panel.

8. The writing box of claim 7 wherein said headphone includes switch means for turning off the radio except when the headphone is operatively positioned on a person's head, whereby the radio is prevented from being inadvertantly left on when the writing box is in a stored non-use condition.

* * * * *